US005689959A

United States Patent [19]

Yatsuzuka et al.

[11] Patent Number: 5,689,959

[45] Date of Patent: Nov. 25, 1997

[54] PULSE TUBE REFRIGERATOR AND METHOD OF USING THE SAME

[75] Inventors: Shinichi Yatsuzuka; Yasumasa Hagiwara, both of Kariya, Japan

[73] Assignee: Advanced Mobile Telecommunication Technology Inc., Nisshin, Japan

[21] Appl. No.: 622,146

[22] Filed: Mar. 27, 1996

[30] Foreign Application Priority Data

Oct. 12, 1995 [JP] Japan ..... 7-264187

[51] Int. Cl.[6] ..... F25B 9/00

[52] U.S. Cl. ..... 62/6; 60/520

[58] Field of Search ..... 62/6; 60/620

[56] References Cited

U.S. PATENT DOCUMENTS

| | | | |
|---|---|---|---|
| 5,269,147 | 12/1993 | Ishizaki et al. | 62/6 |
| 5,295,355 | 3/1994 | Zhou et al. | 62/6 |
| 5,357,757 | 10/1994 | Lucas | 62/6 |

OTHER PUBLICATIONS

Cryogenic Engineering, vol. 3, No. 5, (1968) pp. 201–207 "Pulse–Tube Refrigerator".

Superconductivity and Cryogenic Engineering Handbook, Nov. 30, 1993, pp. 206–208, "Modified Pulse–Tube Refrigerator".

*Primary Examiner*—Ronald C. Capossela

*Attorney, Agent, or Firm*—Cushman, Darby & Cushman IP Group of Pillsbury Madison & Sutro LLP

[57] ABSTRACT

To improve refrigerating efficiency by preventing working fluid flowing into a pulse tube from a high-temperature end side thereof from reaching a cooling part in a cryogenic refrigerator, a ball-shaped travel member which has almost the same cross-section as the cross section of the pulse tube is inserted into the pulse tube and moves together with the working fluid therein. In this arrangement, when the working fluid begins to flow into the pulse tube from a flow rate regulation part on the high-temperature end side of the pulse tube, the travel member located within the pulse tube moves toward a cooling part together with the working fluid flowing in the pulse tube. Since the travel member has almost the same cross-section as the cross-section of the pulse tube, there is no possibility that the working fluid flows through between the inner wall of the pulse tube and the travel member. Therefore, the travel member can reliably prevent the working fluid flowing into the high-temperature end of the pulse tube from reaching the cooling part, and thereby the refrigerating efficiency of the pulse tube refrigerator can be improved.

18 Claims, 2 Drawing Sheets

PULSE TUBE REFRIGERATOR AND METHOD OF USING THE SAME

CROSS-REFERENCE TO RELATED APPLICATIONS

The present application is related to and claims priority from Japanese Patent Application No. Hei. 7-264187, incorporated herein by reference.

BACKGROUND OF THE INVENTION

1. Field of the Invention

The present invention generally relates to pulse tube refrigerators, and more particularly to a pulse tube refrigerator for cooling a cooling object to cryogenic temperatures so that it can be used as a cooling sensor, an infrared sensor, a sensor for superconductive materials, etc.

2. Description of the Related Art

Conventional pulse tube refrigerators are constructed as illustrated in FIGS. 5, 6 and 7. FIG. 5 illustrates what is known as an orifice-type pulse tube refrigerator composed of a compression part 1, a regenerator 3, a cooling part 8, a pulse pipe 2, a flow rate regulation part 4A and a buffer tank 6 which are connected in series in that order.

FIG. 6 illustrates what is known as a double inlet-type pulse tube refrigerator, which is an improved version of the orifice-type machine illustrated in FIG. 5. In the double inlet type, a pipe 9 between the compression part 1 and the regenerator 3 and a pipe 10 between the pulse tube 2 and the first flow rate regulation part 4A are connected with each other via a bypass pipe 5, and a second flow rate regulation part 4B is provided in the bypass pipe 5 therebetween.

FIG. 7 illustrates what is known as a double piston-type pulse tube refrigerator with the first compression part 1, the regenerator 3, the cooling part 8, the pulse tube 2 and a second compression part 11 connected in series in that order.

Within the airtight space of the vacuum container in which these components are disposed is sealed working fluid (refrigerant gas), such as He, Ar, $N_2$, $O_2$, $H_2$ and air. By repeating the alternating compression and expansion of the working fluid within the compression part 1, the working fluid is cooled to be cryogenic within the cooling part 8, and a cooling object (not illustrated) on the cooling part 8 can be cooled to be cryogenic.

In addition, in the pulse tube refrigerator, a component attached to the high-temperature end of the pulse tube 2 (e.g., the buffer tank 6 in FIG. 5) largely contributes to the refrigerating action by reciprocating with a specified phase difference against the displacement of the piston of the compression part 1.

Refrigerating efficiency is one of the indices of the performance of a refrigerator. The refrigerating efficiency of the pulse tube refrigerator is still so low that there is room for improvement.

According to the test and study by the inventors of the present invention, when the working fluid gushes from the high-temperature end side of the pulse tube 2 into the pulse tube 2, the working fluid does not stay on the high-temperature side of the pulse tube 2 but penetrates throughout the working fluid already within the pulse tube 2, and reaches the cooling part 8. The flowing of this working fluid higher in temperature than the cooling part 8 into the side of the cooling part 8 may cause deterioration of the refrigerating efficiency.

SUMMARY OF THE INVENTION

In view of the above problem, it is an object of the present invention to prevent the working fluid flowing from the component on the high-temperature end side into the pulse tube from reaching the side of the cooling part.

The above object is achieved in a preferred embodiment of the present invention by providing a freely moveable travelling member in the pulse tube. The travelling member can slide back and forth in the pulse tube in response to changes in the relative pressures of the working fluid at the ends of the pulse tube; however, it is of such a diameter that the fluid flowing from the buffer tank side cannot pass through to the compressing part side to reduce the refrigerating efficiency as described above. In this way, mixing of the fluids can be avoided and high efficiency maintained.

The travelling part may be ball-shaped or column-shaped. If column-shaped, it may have flat faces exposed to the working fluid or conical faces. Preferably, the travelling member is made of a low thermal conductivity material and its faces are coated with a high durability material. The travelling part may be disposed in the regenerator of an orifice-type refrigerator, a double inlet-type refrigerator, or a double-piston refrigerator.

The above object is achieved in another aspect of the invention by providing a method of cooling a working fluid in a pulse tube refrigerator using a travelling part as described above.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings.

Figure 1:
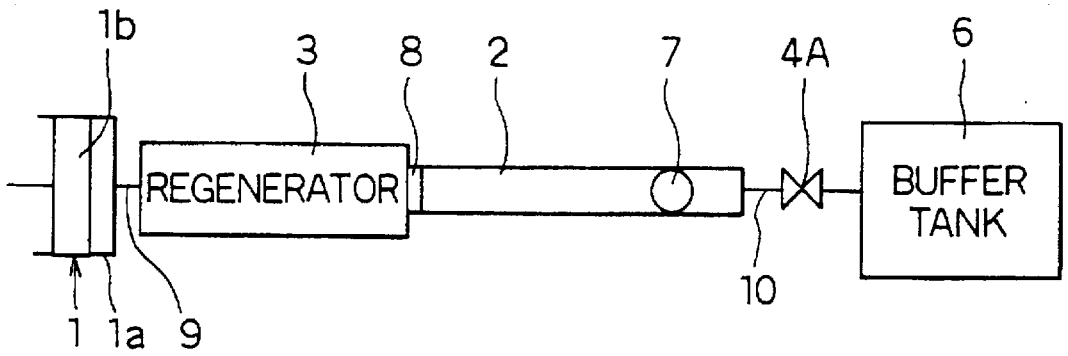
FIG. 1 is a view illustrating the entire construction of a pulse tube refrigerator of a first embodiment according to the present invention.

FIG. 1 illustrates a first embodiment of the present invention which is applied to an orifice-type pulse tube refrigerator. In this machine, a compression part 1, a regenerator 3, a cooling part 8, a pulse tube 2, a flow rate regulation part 4A and a buffer tank 6 are connected in series in that order.

Within the pulse tube 2 is freely movably inserted a travel member 7 for separating working fluid on the high-temperature end side of the pulse tube 2 (i.e., the end part of the flow rate regulation part 4A) from fluid in the remainder of the tube 2.

Here, the regenerator 3, the cooling part 8 and the pulse tube 2 are disposed within a vacuum container (not illustrated) to be insulated from external heat.

Furthermore, working fluid (refrigerant gas), such as He, Ar, $N_2$, $O_2$, $H_2$ and air is sealed at a specified high pressure within the airtight space of the vacuum container in which these components are disposed.

The compression part 1 has a cylinder 1*a* and a piston 1*b* which is driven by the driving force of a driving means, such as a motor (not shown) to reciprocate within the cylinder 1*a*. The reciprocating motion of the piston 1*b* alternatingly compresses and expands the working fluid, creating pressure waves therein.

The regenerator 3 is an airtight container in which meshes made of a metal such as stainless steel, copper or copper alloy, are stacked or balls or the like made of a metal such as stainless steel or lead, are sealed to accept the energy of the working fluid expanding while passing through the inside thereof. Therefore, it is preferable that the material of the regenerator 3 should be sufficiently larger in heat capacity than the working fluid.

The cooling part 8 made of a metal having a high thermal conductivity, such as copper, is attached to the regenerator 3 at the end of the pulse tube 2. The cooling part 8 cools a cooling object contacting the outer wall surface thereof.

The pulse tube 2 is a cylindrical thin-wall pipe made of a metal, such as stainless steel, titanium or titanium alloy. Pressure waves which are generated by the alternation of the compression stroke and expansion stroke of the compression part 1 are applied to the pulse tube 2 through the regenerator 3. These pressure waves make the working fluid repeat compression and expansion to displace and carry the heat.

The flow rate regulation part 4A is a pipe-like structure or the like whose diameter is equivalent to the diameter of a flow rate regulation valve or a specified throttle amount.

Jointly with the flow rate regulation part 4A, the buffer tank 6 plays a role of regulating the phases of the displacement of the working fluid against the pressure waves of the working fluid.

The travel member 7 can smoothly move within the pulse tube 2 together with the working fluid passing through the flow rate regulation part 4A and flowing into or out of the high-temperature end of the pulse tube 2. The travel member 7 of this construction is designed to prevent the working fluid on the high-temperature side from passing thereover and flowing into the side of the cooling part 8. Accordingly, the travel member 7 is made of a lightweight resin family material, such as styrene foam, resin (e.g., acrylic acid resin) and urethane, and in this embodiment, shaped into a ball whose diameter is substantially the same as the inner diameter of the pulse tube 2 (i.e., whose cross-section is almost the same as the cross-section of the pulse tube 2). "Substantially" as used herein and in the appended claims, means a diameter such that the travel member 7 smoothly moves within the pulse tube 2 with a minute clearance from the inner wall of the pulse tube 2 without permitting almost all the working fluid to pass thereover.

In this way, the travel member 7 can prevent the working fluid within the buffer tank 6, which is higher in temperature (roughly as high as room temperature) than the cooling part 8, from flowing from the high-temperature end of the pulse tube 2 to the side of the cooling part 8. As a result, a higher refrigerating efficiency can be achieved.

In order to achieve good heat transmission within the regenerator 3 by means of the pressure waves of the working fluid generated by the alternation of the compression and expansion of the fluid within the compression part 1, the travel member 7 should be able to smoothly move (i.e., oscillate) responsive to minute pressure differences. Accordingly, it is preferable that the travel member 7 should be made of a lightweight resin family material as described above.

Furthermore, by making the travel member 7 from a lightweight resin family material (i.e., material having a low thermal conductivity) as described above, the heat transmitted through the travel member 7 itself can also be reduced, and thereby the refrigerating efficiency can further be improved.

According to this embodiment, the travel member 7 is ball-shaped and has a diameter almost equivalent to the inside diameter of the pulse tube 2, thereby prohibiting the working fluid from passing thereover, or slightly smaller than the inside diameter of the pulse tube 2 to be able to smoothly move through the pulse tube 2.

Figure 2:
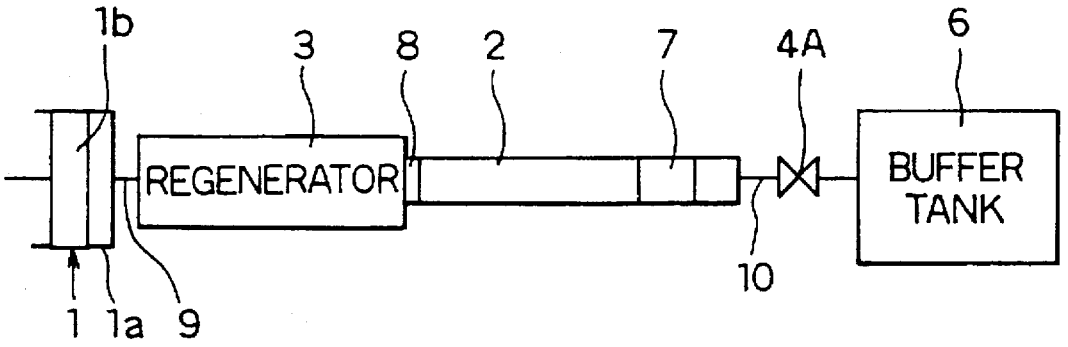
FIG. 2 is a view illustrating the entire construction of a pulse tube refrigerator of a second embodiment according to the present invention.

FIG. 2 illustrates a second embodiment according to the present invention which is different from the first embodiment in that the travel member 7 is column-shaped.

Figure 3:
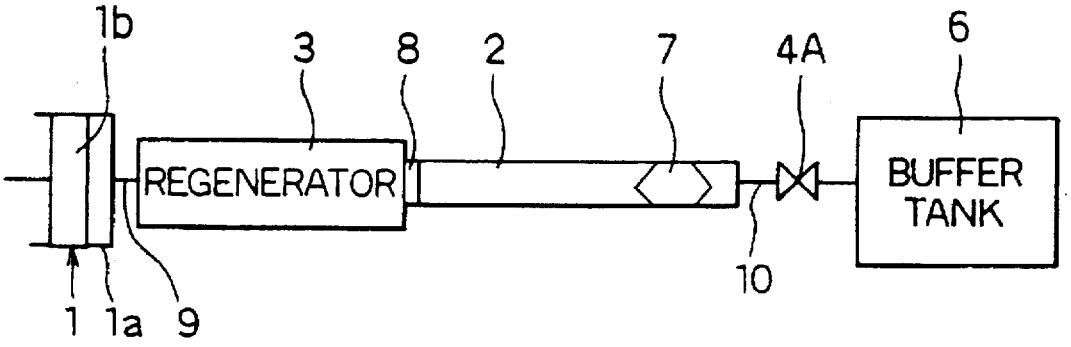
FIG. 3 is a view illustrating the entire construction of a pulse tube refrigerator of a third embodiment according to the present invention.

In a third embodiment according to the present invention illustrated in FIG. 3, the column-shaped travel member 7 is cone-shaped at both ends.

Figure 4:
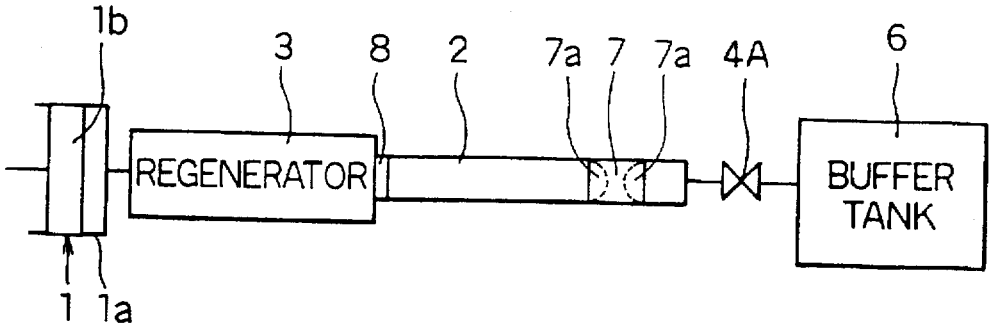
FIG. 4 is a view illustrating the entire construction of a pulse tube refrigerator of a fourth embodiment according to the present invention.
Figure 5:
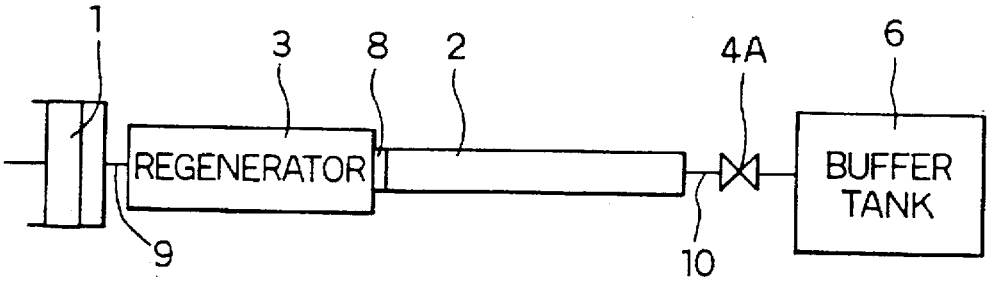
FIG. 5 PRIOR ART
FIG. 5 is a view illustrating the entire construction of a conventional orifice-type pulse tube refrigerator.

FIG. 4 illustrates a fourth preferred embodiment according to the present invention. The travel member 7 of the fourth embodiment is provided with resin coating layers 7*a* to improve the durability of the travel member 7 which is subjected to the bumps of the working fluid at both ends. Coating layers 7*a* may be made of resin or, preferably, a polymeric material such as Teflon®.

Although presently preferred embodiments of the invention have been described with respect to orifice-type pulse tube refrigerators, the present invention is also applicable to any other type of refrigerators as long as the high-temperature side working fluid flows into the pulse tube 2 through the high-temperature end of the pulse tube 2.

Figure 6:
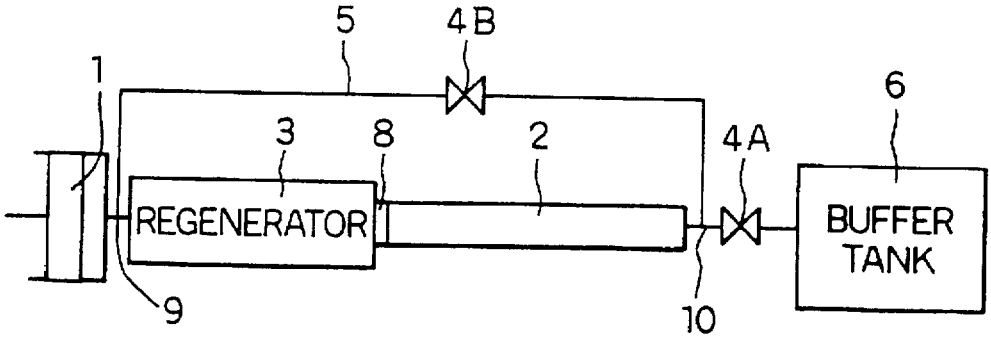
FIG. 6 PRIOR ART
FIG. 6 is a view illustrating the entire construction of a conventional double-inlet type pulse tube refrigerator.
Figure 7:
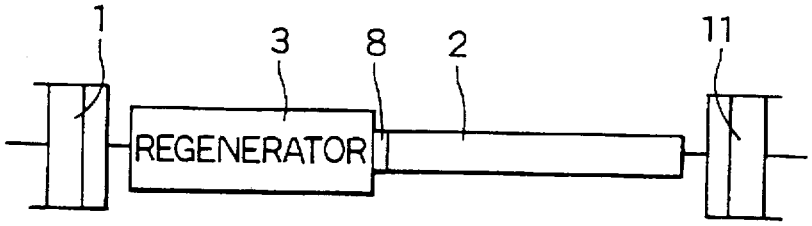
FIG. 7 PRIOR ART
FIG. 7 is a view illustrating the entire construction of a conventional double piston-type pulse tube refrigerator.

For example, the present invention can have the same mode of operation and effect as those of the above-described embodiments when applied to a double inlet-type pulse tube refrigerator constructed as illustrated in FIG. 6 or a double piston-type pulse tube refrigerator constructed as illustrated in FIG. 7 by inserting the travel member 7 within the pulse tube 2.

It should be noted that when the present invention is implemented in the double inlet structure of FIG. 6, there will be a small amount of high temperature working fluid flowing from the buffer tank 6 to the compressing part 1 through the bypass pipe 5, thereby slightly reducing the efficiency of the device; however, compared to the overall flow in the pulse tube 2, the backflow in the bypass pipe 5 is negligible.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A pulse tube refrigerator comprising:

a compression part;

a regenerator having a first end connected to said compression part;

a cooling part having a first end connected to a second end of said regenerator;

a pulse tube having a first end connected to a second end of said cooling part;

a high-temperature section connected to a second end of said pulse tube; and a travel member, in said pulse tube, for moving together with working fluid in said pulse tube to separate working fluid on an end of said pulse tube most proximate to said high-temperature section and working fluid on an end of said pulse tube most proximate to said cooling part from each other.

2. The pulse tube refrigerator of claim 1, said high temperature section comprising:

a flow rate regulation part having a first end connected to a second end of said pulse tube; and a buffer tank connected to a second end of said flow rate regulation part;

wherein said refrigerator has an orifice-type refrigerator structure.

3. The pulse tube refrigerator of claim 1, wherein:

said high temperature section comprises a flow rate regulation part having a first end connected to a second end of said regenerator, a buffer tank connected to a second end of said flow rate regulation part, a bypass pipe having a first end connected to a connection between said compression part and said regenerator and a second end connected to a connection between said regenerator and said first flow rate regulation part, and an additional flow rate regulation part in said bypass pipe; and said refrigerator has a double inlet-type refrigerator structure.

4. The pulse tube refrigerator of claim 1, wherein:

said high temperature section comprises an additional compression part connected to a second end of said pulse tube; and said refrigerator has a double piston-type refrigerator structure.

5. The pulse tube refrigerator of claim 1, wherein said travel member has substantially a same cross-section as an inner diameter of said pulse tube.

6. The pulse tube refrigerator of claim 1, wherein said travel member is ball-shaped.

7. The pulse tube refrigerator of claim 1, wherein said travel member is column-shaped.

8. The pulse tube refrigerator of claim 1, wherein said travel member has material having a higher durability than a remainder of said travel member disposed on surfaces of said travel member contacting said working fluid.

9. The pulse tube refrigerator of claim 1, wherein said travel member is disposed in an end of said pulse tube most proximate to said high-temperature section.

10. The pulse tube refrigerator of claim 1, wherein said travel member is made of a lightweight resin family material having a low thermal conductivity.

11. A method of cooling a working fluid in a pulse tube refrigerator, said method comprising the steps of:

alternately compressing and expanding a first working fluid to cool it to a cryogenic temperature;

providing said cooled first working fluid in a first end of a pulse tube;

providing a second working fluid at a second end of said pulse tube, said second working fluid being responsive to changes in pressure at said first end of said pulse tube; and preventing said second working fluid from flowing to said first end of said pulse tube.

12. The method of claim 11, wherein said preventing step comprises a step of using a traveling member disposed in said pulse tube to block flow of said second working fluid.

13. The method of claim 12, wherein said using step comprises a step of allowing said travelling member to move freely in said pulse tube responsive to relative pressures at said first and second ends of said pulse tube.

14. A pulse tube refrigerator comprising:

a compression part;

a regenerator having a first end connected to said compression part;

a cooling part having a first end connected to a second end of said regenerator;

a pulse tube having a first end connected to a second end of said cooling part;

a high-temperature section connected to a second end of said pulse tube; and fluid temperature control means for preventing heat transfer between working fluid on an end of said pulse tube most proximate to said high-temperature section and working fluid on an end of said pulse tube most proximate to said cooling part.

15. The pulse tube refrigerator of claim 14, said fluid temperature control means comprising a travel member, in said pulse tube, for moving together with working fluid in said pulse tube to prevent heat transfer between said working fluid on said end of said pulse tube most proximate to said high temperature section and working fluid on said end of said pulse tube most proximate to said cooling part.

16. The pulse tube refrigerator of claim 14, wherein said fluid temperature control means has substantially a same cross-section as an inner diameter of said pulse tube to prevent heat transfer via flow of working fluid from said high temperature section to said cooling part.

17. The pulse tube refrigerator of claim 14, wherein said fluid temperature control means is disposed in an end of said pulse tube most proximate to said high-temperature section.

18. The pulse tube refrigerator of claim 14, wherein said fluid temperature control means is made of a lightweight resin family material having a low thermal conductivity to prevent heat transfer between said working fluid on said end of said pulse tube most proximate to said high-temperature section and said working fluid on said end of said pulse tube most proximate said cooling part.

* * * * *